US006875911B2

(12) United States Patent
Schryer

(10) Patent No.: US 6,875,911 B2
(45) Date of Patent: Apr. 5, 2005

(54) TREMOLO DEVICE FOR A STRINGED MUSICAL INSTRUMENT

(76) Inventor: Thomas G. Schryer, 2635 River Rd., Willoughby Hills, OH (US) 44094

( * ) Notice: Subject to any disclaimer, the term of this patent is extended or adjusted under 35 U.S.C. 154(b) by 17 days.

(21) Appl. No.: 10/402,510

(22) Filed: Mar. 28, 2003

(65) Prior Publication Data

US 2003/0183062 A1 Oct. 2, 2003

Related U.S. Application Data

(60) Provisional application No. 60/368,283, filed on Mar. 28, 2002.

(51) Int. Cl.[7] ..... G10D 3/00
(52) U.S. Cl. ..... 84/313
(58) Field of Search ..... 84/313, 312, 310 N, 84/312 R, 314 N

(56) References Cited

U.S. PATENT DOCUMENTS

| | | | | |
|---|---|---|---|---|
| 2,152,783 A | | 4/1939 | Beauchamp | |
| 2,949,806 A | | 8/1960 | Turman | |
| 3,014,395 A | | 12/1961 | Blair | |
| 3,124,991 A | | 3/1964 | Costen | |
| 4,512,232 A | | 4/1985 | Schaller | |
| 4,632,005 A | | 12/1986 | Steinberger | |
| 4,648,304 A | | 3/1987 | Hoshino et al. | |
| 4,712,463 A | | 12/1987 | Kubicki et al. | |
| 4,967,631 A | * | 11/1990 | Rose | 84/313 |
| 5,088,374 A | | 2/1992 | Saijo | |
| 5,265,512 A | | 11/1993 | Kubicki et al. | |
| 5,847,297 A | | 12/1998 | Fisher, IV | |
| 5,986,190 A | * | 11/1999 | Wolff et al. | 84/297 R |
| 6,040,511 A | | 3/2000 | Hall | |
| 6,118,057 A | | 9/2000 | Chang | |
| 6,300,550 B1 | * | 10/2001 | Smith | 84/298 |
| 6,552,252 B2 | | 4/2003 | Hirayama | |

FOREIGN PATENT DOCUMENTS

| | | |
|---|---|---|
| JP | 6-167968 A | 6/1994 |
| WO | WO 86/04715 | 8/1986 |

OTHER PUBLICATIONS

International Search Report relating to PCT/US03/09836.

* cited by examiner

*Primary Examiner*—Kimberly Lockett
(74) *Attorney, Agent, or Firm*—Fay, Sharpe, Fagan, Minnich & McKee, LLP

(57) ABSTRACT

A tremolo device for a stringed instrument comprising a base adapted to attach to an associated stringed instrument. A plurality of adjustable string supports are pivotally attached to the base. Each of the supports supports a string of the associated stringed instrument, wherein each of the string supports includes a surface configured such that 1 degree of rotation of the support in relation to the base results in a change in length of the string equal to l, a constant, multiplied by the change in length of the string that resulted from the preceding 1 degree of rotation. The tremolo device can accurately bend and/or modify the chords made by such stringed instrument.

32 Claims, 8 Drawing Sheets

TREMOLO DEVICE FOR A STRINGED MUSICAL INSTRUMENT

CROSS-REFERENCE TO RELATED APPLICATION

This application claims priority from U.S. Provisional Application Ser. No. 60/368,283, filed on Mar. 28, 2002.

BACKGROUND OF THE INVENTION

The present invention relates to a tremolo device for a stringed musical instrument. More particularly, the invention relates to a tremolo device which effectuates a desired substantially uniform change in pitch of all the strings of the instrument upon rotation of a portion of the device in relation to the stringed instrument.

Tremolo devices come in many forms but almost all involve some sort of rotation that simultaneously tightens or loosens all of the strings of the musical instrument. A tightened string produces a higher pitch. The musician typically operates an arm on the device, which in turn rotates a portion of the tremolo device to loosen or tighten the strings.

Tremolo devices currently available for electric guitars and other stringed instruments have at least the following shortcomings. Some tremolo devices change the pitch of the various strings by significantly different amounts. As a result, they do not accurately "bend" chords. In other tremolo devices, retuning one string results in the modification of the pitch of another previously tuned string. Yet other devices can not be readily modified to change the pitch of the strings by equal amounts when the strings are tuned in an alternative tuning pattern of relative pitches, even for the relatively few devices that change the pitch of the various strings by essentially equal amounts when standard tuning is used.

Some tremolo devices include activator arms that require a relatively large force to operate them. Existing tremolo devices are also typically very expensive and beyond the abilities of an average musician to set up, maintain, and modify. These devices cannot be modified in a reasonable amount of time by the musician to transform a chord accurately to another chord. For example, a chord progression from A (minor) to G (major) is a popular progression. It is more satisfying to the user to change the chord from the A (minor) to G (major) via a glissando, i.e., a smooth, continuous decrease in pitch.

However, almost all existing tremolo devices destroy the intended relationship between the pitches of the various strings when the device is used to make any significant tonal modification. Typically, the string most sensitive to the changes in tension will change in pitch roughly three to four times that of the least sensitive string. In other words, almost all existing tremolo devices essentially destroy chords.

Another shortcoming of existing tremolo devices is that when one string is tightened when retuned, such extra tension compresses a spring that counterbalances the device and reduces the pitches of the remaining strings. Therefore, the tuning of one string usually causes the remaining strings to go out of tune slightly thus requiring the instrument to be retuned several times before all strings are in tune. Such tremolo devices may require recalibration of the entire unit.

Accordingly, it is desirable to provide a tremolo device that overcomes the above-mentioned shortcomings and others while providing better and more advantageous overall results. Other aspects of the invention will become apparent from reading the following detailed description.

SUMMARY OF THE INVENTION

The present invention is primarily another step in the evolution of the "whammy bar" for popular electric guitars, but it can be used on other stringed musical instruments as well. The tremolo device produces vibrato (pitch changes) for all strings at the same time. The musical instrument with which the tremolo device will be used will preferably include 1) a tuning mechanism for each of a plethora of strings at the top, 2) a "slippery" nut over which each string can move easily without "catching", 3) a neck (either fretted or fretless) onto which the string can be pressed to effectively change pitch, 4) a body area that may include electronic signal pickups, and 5) a "slippery" bridge over which each string can move easily without "catching". The present invention accurately bends chords and solves the shortcomings described above.

The device uses a cam-like wheel for which each one degree rotation "unreels" a length of string equal to 1.010 times the amount "unreeled" by the previous 1-degree rotation slackening of the strings. The shape of the cam was developed using "successive relaxation" iterations.

The preferred embodiment includes a base that will 1) hold the pivoting detuning mechanism (that also anchors one end of each of the strings), 2) hold the adjustable spring that will counterbalance the pivoting force exerted on the detuning mechanism by the force of the strings, 3) provide a slot into which a lock can slide (that can hold the detuning mechanism in the neutral position and keep it from rotating), 4) provide accurately-placed holes that will hold the bridge at the position required for proper operation of the detuning mechanism, and 5) fit onto the model of instrument for which it is designed.

The length of string tightening needed to move the pitch up one half step equals the sixth root of 2 ($2^{(1/6)}$) times the previous length of string tightening needed to move the pitch up one half step (in a series of one half step pitch increases). This is true both in real observation and in the study of stringed instrument theory.

Having a "rotationally predictable" and numerically calibrated mechanism allows more efficient and proper setup at the factory and allows the device to be reset efficiently later to accommodate various changes. During changing the tuning of a string by one half step the amount of unreeling needs to be changed by a factor of $2^{(1/6)}$. The device needs to have the relative rotational positioning of the adjuster for the string involved to be changed by 11.61 degrees (since $1.010^{11.61}$ equals $2^{(1/6)}$). Note that 11.61 degrees also equals one thirty-first (1/31) of a rotation. The device is calibrated so that the unreeling elements can be adjusted in increments of one half of 11.61 degrees. This assures that the device is within 3 degrees of the correct setting and is within 3% of a perfect pitch change for any given string. Electronic tuning devices are calibrated digitally to indicate pitch change increments equal to multiples of 10% of a half step; therefore, there is not demand for more accuracy from musicians. Also, a plucked string will often change pitch by 10% or more (as percentages of a half step's pitch change) in the three seconds following the moment of activation.

Since each string has its own adjustable mechanism, each is adjustable so that more, or less, pitch change can be realized by a given amount of rotation of the entire detuning mechanism so the device can be set so all six notes in a G chord played on a 6-string guitar will accurately be detuned to the notes in an $F^{\#}$ chord. Each set of commercially available strings has an appropriate pattern of settings.

Proper assembly at the factory becomes more efficient since the "adjustment" task is essentially eliminated by using the index marks embossed on adjustable unreeling wheels to set the wheels properly, as detailed in the preferred embodiment below. The stretching of the strings during their normal course will not change the physics of the device. As long as strings are replaced with the same gauge of strings, the device should never need to be reset. Having identically molded parts with settings marked as described above makes production more economical and facilitates needed adjustments.

For example, if an unreeling cam is reset by adding 1.1 to the regular setting (e.g. "2.8" instead of "1.7") it will release one half step when the other strings release two half steps. Musically, this can allow a minor chord (e.g. $A^M$ (minor)) to transform to a major chord (e.g. G(major)) two half steps lower. Alternatively, by subtracting 1.1 from the regular setting it will release two half steps when the other strings release one half step (allowing a G to transform into an $F^{\#M}$).

According to one aspect of the present invention, a tremolo device for a stringed instrument comprises a base adapted to attach to an associated stringed instrument; and a plurality of string supports pivotally attached to the base. Each of the supports supports a string of the associated stringed instrument, and each string support includes a surface configured such that when releasing string a 1 degree of rotation of the support in relation to the base results in a change in length of the string equal to l, a constant, multiplied by the change in length of the string that resulted from the preceding one degree rotation of the support. The constant l is preferably equal to 1.010. Constant l can also be selected from a range from 1.005 to 1.050. Adjustment of one of the string supports does not affect the pitch modification characteristics of the remaining string supports. Furthermore, the adjustment of the string support can be made to accurately bend a chord made by the instrument.

Wheels are also provided upon which the string supports are mounted. A carriage is pivotally mounted to the base within an opening of the base. The wheels are rotatably mounted within the carriage. The carriage comprises a string-anchoring member extending from an edge of the carriage comprising a plurality of slots for retaining the strings. The base can comprise slots on opposing ends of the opening for retaining the carriage within the base. The carriage can comprise at least one restraint member positioned within the opening to inhibit movement of the wheels in relation to the carriage. The carriage can also comprise trunnions extending from opposite sides of the carriage which rotatably mount the carriage to the base.

Each of the string supports comprises a cam upon which the string is supported. The cams are mounted to the wheels. Each of the wheels has at least one visual aligning groove. The grooves preferably have ink therein. A retaining member can be positioned over the carriage and comprises at least one finger portion which is aligned with a visual aligning groove of a wheel.

An arm is pivotally mounted to the carriage for tilting the carriage. A half step stop peg is mounted to either the stringed instrument or the base, and a retractable tab can be extended below the arm, so that when the tab contacts the peg further movement of the carriage is prevented. Alternatively, the carriage can comprise knife edge pivot members that engage a portion of the base to allow rotating of the carriage. The knife edge pivot members are detachable from the carriage and include a plurality of arcuate surfaces, wherein at least one of the arcuate surfaces engages the portion of the base.

In accordance with another aspect of the invention, a tremolo device for a stringed instrument comprises a plurality of string supports pivotally attached to the instrument. Each of the supports supports a string of the instrument. Each of the string supports comprises an adjustable peripheral surface that is shaped such that the amount of string released by one degree of rotation of the support divided by the amount of string released by the preceding one degree of rotation of the support is equal to a constant.

In accordance with another aspect of the invention, a tremolo device for a stringed instrument comprises a base adapted to attach to an associated stringed instrument, and a carriage pivotally mounted to the base via knife edge members. The knife edge members are detachable from the carriage and include a plurality of arcuate surfaces, wherein at least one of the arcuate surfaces engages a portion of the base.

In accordance with yet another aspect of the present invention, a method is provided for using a tremolo device with a string of a musical instrument when the string is tuned n half-steps from a datum pitch such that the tremolo device bends chords upon pivoting of the tremolo device with respect to the musical instrument. The method comprises providing alternative adjustment settings for each string so that the tremolo device releases $2^{(n/6)}$ times the amount of string released prior to adjusting the tremolo device for the retuned string, where n is the desired number of half-steps away from the datum pitch to which the string will be tuned.

In accordance with another aspect of the invention, a tremolo device for a stringed instrument comprises a housing and an activator member located within the housing. A string of the instrument extends over a portion of the activator member. A ramp has a plurality of notches therein. An end of the activator member engages one of the notches. The activator member is rotated with respect to the ramp and engages a notch therein, thus changing the tension of the string. The notches are configured such that when the activator member engages one of the notches a portion of the activator member is located at a radius equal to $2^{n/12}$ times the radius when the activator member engages an adjacent notch.

In accordance with another aspect of the invention, a tremolo device for a stringed instrument comprises a rotatable tubular member upon which a string is releasably mounted, a housing which supports the tubular member, and an adjustable member mounted to the tubular member via a fastener that controls the rate at which string is released. The tubular member comprises a plurality of notches. The housing comprises at least one peg. The tubular member is rotated so that one of the notches engages the peg of the housing. The notches are positioned such that each counterclockwise rotation of said tubular member to a notch position releases $2^{(1/6)}$ times the amount of string as a previous notch position.

Still other aspects of the invention will become apparent to those skilled in the art upon a reading and understanding of the following detailed description.

BRIEF DESCRIPTION OF THE DRAWINGS

The invention may take form in certain components and structures, preferred embodiments of which will be illustrated in the accompanying drawings wherein.

DETAILED DESCRIPTION OF THE INVENTION

Figure 1:
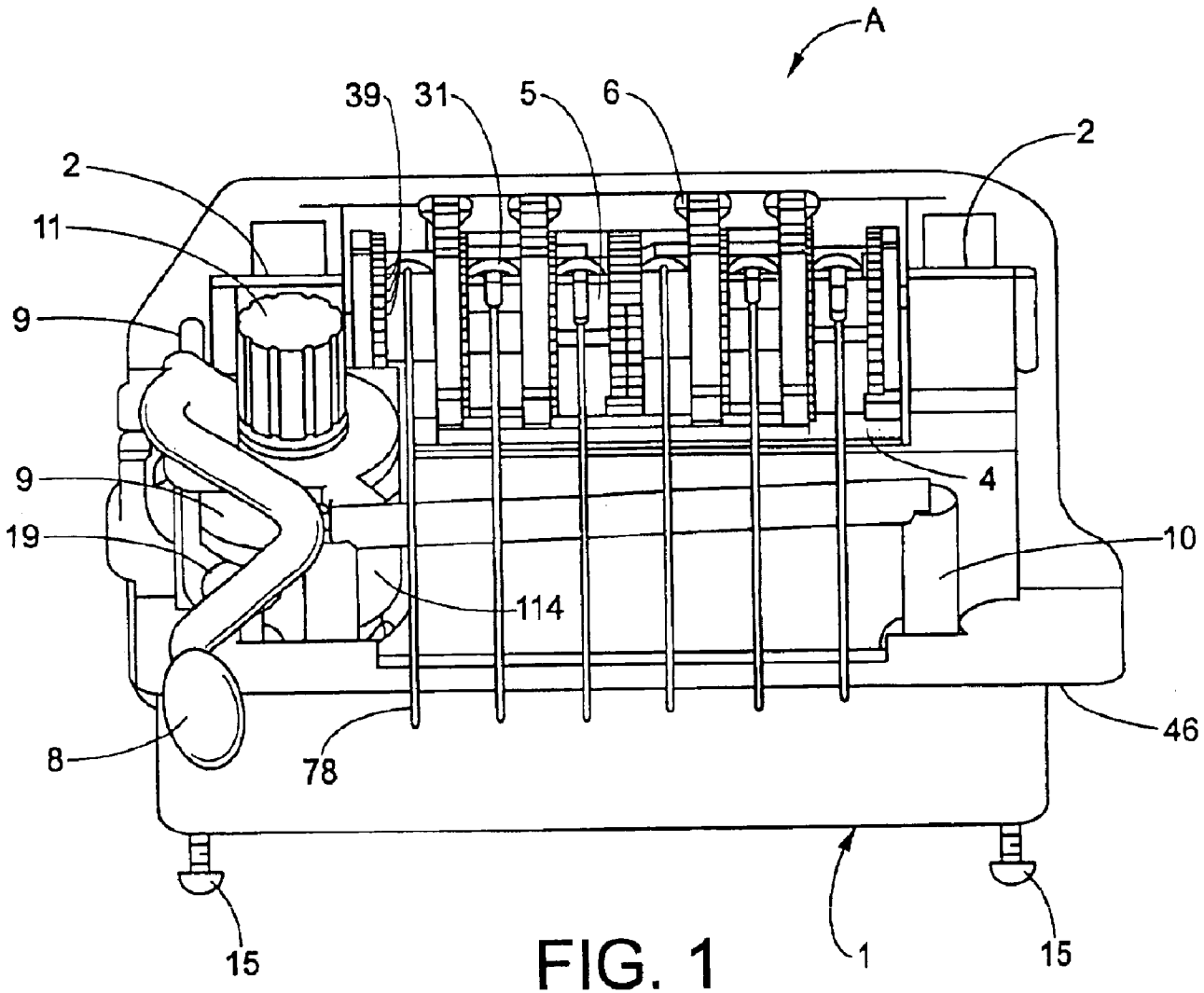
FIG. 1 is a perspective view of a tremolo device in accordance with a preferred embodiment of the present invention.

Referring now to the FIGURES, wherein the showings are for purposes of illustrating preferred embodiments of the invention only and not for purposes of limiting same, FIG. 1 illustrates a preferred embodiment of the present invention.

An inventive tremolo device is to be mounted onto the body of a stringed musical instrument having a plurality of strings. The musical instrument includes, in order along the path of each string, 1) a portion of the tremolo device that anchors each string using the end of the string with an anchoring protrusion, 2) a portion of the tremolo device that supports and unreels the string between an anchoring plate of the device and a bridge, 3) the bridge, including saddles that will support the string but allow the string to slide with minimal friction, 4) a section to accommodate electronic pick up devices to be used to feed amplification or sound-shaping devices, 5) a neck section, either fretted or fretless onto which the string can be pressed to effectively change pitch, 6) an element or slippery nut that supports the string near the end of the neck over which each string can move easily without catching, and 7) a tuning mechanism anchoring the end of the string that does not have an anchoring protrusion.

Figure 4:
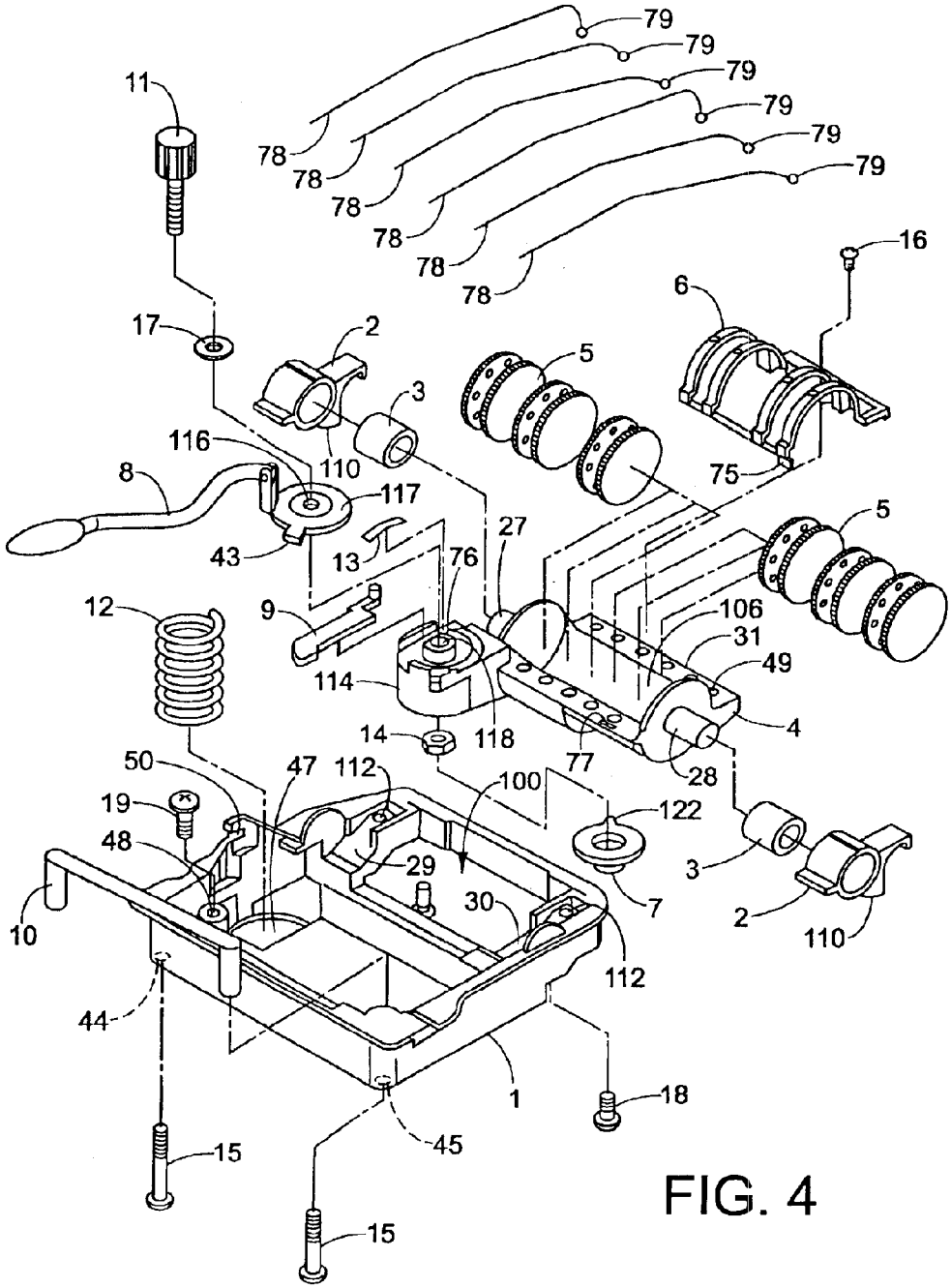
FIG. 4 is an exploded view of the tremolo device of FIG. 1.

With reference now to FIG. 1, a tremolo device A is shown according to a preferred embodiment of the present invention. The device A includes a base 1, a carriage 4 movably mounted to the base, and a plurality of reeling members or wheels 5 removably housed within the carriage 4. The components of the tremolo device are fabricated from metal or another suitable material. The base can include a flange 46 which can cover minor flaws in the shape of a receptacle (not shown) in an associated musical instrument (not shown) which accommodates the tremolo device. The base 1 attaches to the musical instrument via conventional fasteners such as screws 15 that are received through holes in the instrument and are tightened into threaded receptacles 44 and 45 (FIG. 4) at front corners of the base. With reference to FIG. 4, the base includes a first opening or recess 100 that is configured to movably or rotatably mount the carriage 4 to the base. Slots or recesses 29 and 30 for retaining bearing holders 2 and bearings 3 which in turn hold the carriage in place are located at opposite ends of the carriage opening 100. The base also includes a socket 48 for receiving a half-step stop peg 19 and a socket 47 for receiving a main spring 12.

Figure 4A:
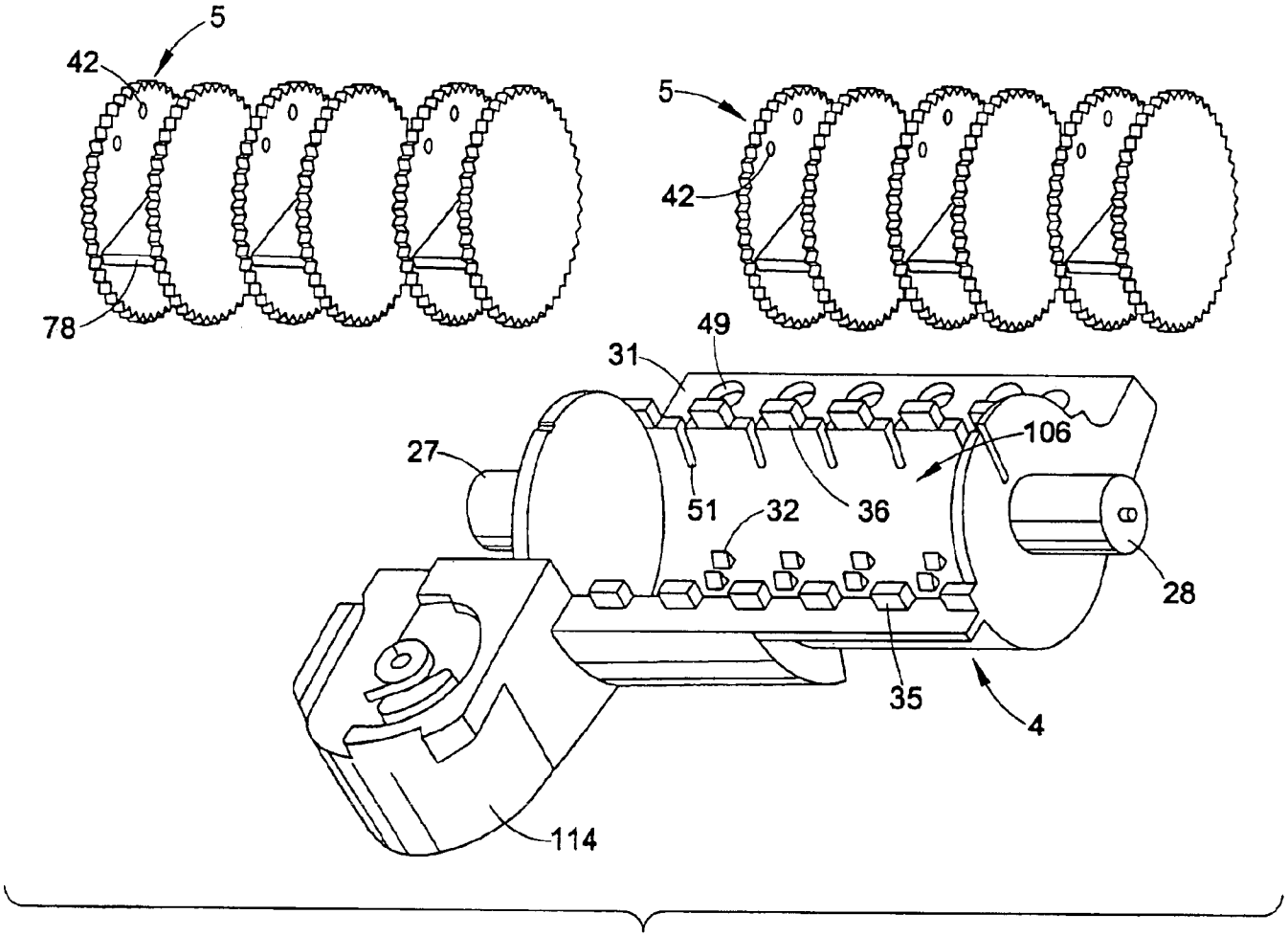
FIG. 4A is an exploded view of a carriage and wheel assembly of the tremolo device of FIG. 4.

With reference to FIG. 4A, the carriage 4 also includes a string-anchoring plate 31 that can either be attached to the carriage or be an integral unit with the carriage. The plate 31 includes a plurality of string access holes 49 which, as shown on FIG. 4 are adapted to receive strings 78 having a doughnut-shaped anchoring protrusion 79 thereon. The holes 49 are preferably spaced along a longitudinal axis of the plate 31. String access slots 51 communicate with the holes such that the anchoring protrusion fits through the holes 49 and each string is slid forward into a corresponding slot 51 to retain the protrusion within plate 31.

The carriage 4 further includes a recess 106 positioned adjacent the string-anchoring plate 31 for receiving the reeling members or adjustable unreeling wheels 5. Positioned within recess 106 are several rotational restraints or tabs 32 which protrude upwardly from a bottom wall of the recess. Alignment restraints 35, 36, which protrude upwardly from a front and rear wall of the recess, each supply a smooth surface for the wheels 5 to rotate upon during adjustment, which is allowed when the wheels 5 are raised to disengage from the rotational restraints 32.

Trunnions 27 and 28 are located at opposite lateral ends of the carriage 4 and fit into bearings 3. The bearings are mounted within holders 2 received within slots 29 and 30. Fasteners 18 are inserted through base holes 112 and holder holes 110 to secure the holders to the base. The trunnions 27 and 28 allow the carriage 4 to pivot or rotate in relation to the base.

FIG. 4 shows a retaining assembly which is positioned over the wheels to retain the wheels in the carriage includes retaining fingers 6 and is installed onto the base by inserting hook 75 into a slot 77 in the carriage and further inserting screw 16 into retaining assembly and the carriage.

Figure 9:
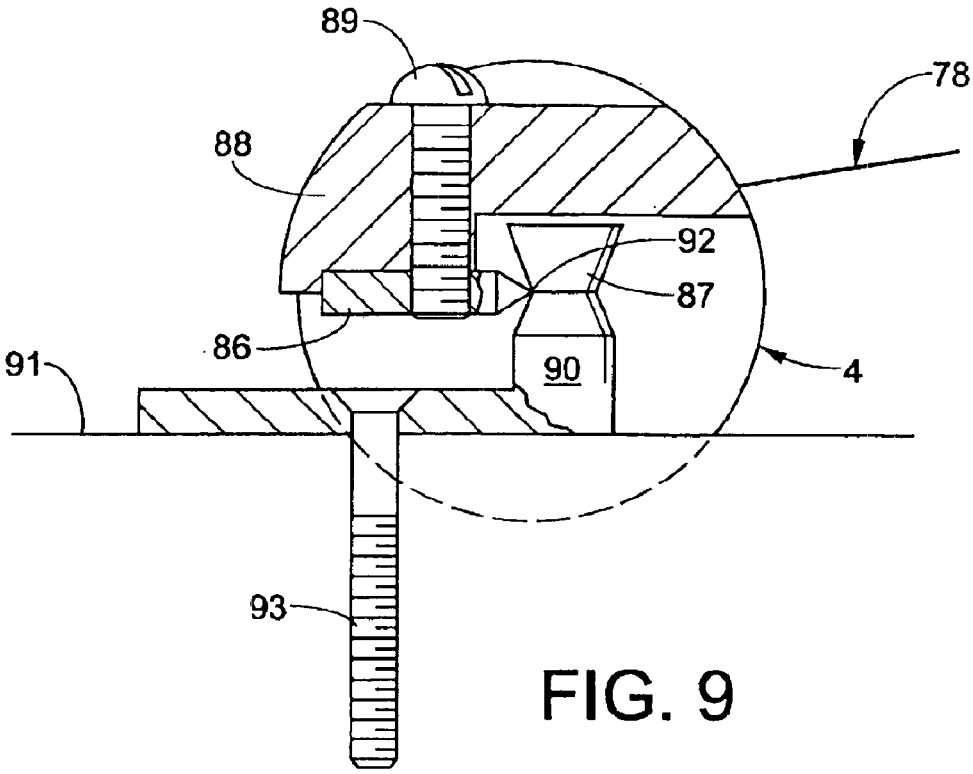
FIG. 9 is a side elevational view of a tremolo device having an alternative pivoting mechanism in accordance with another preferred embodiment of the present invention.
Figure 10:
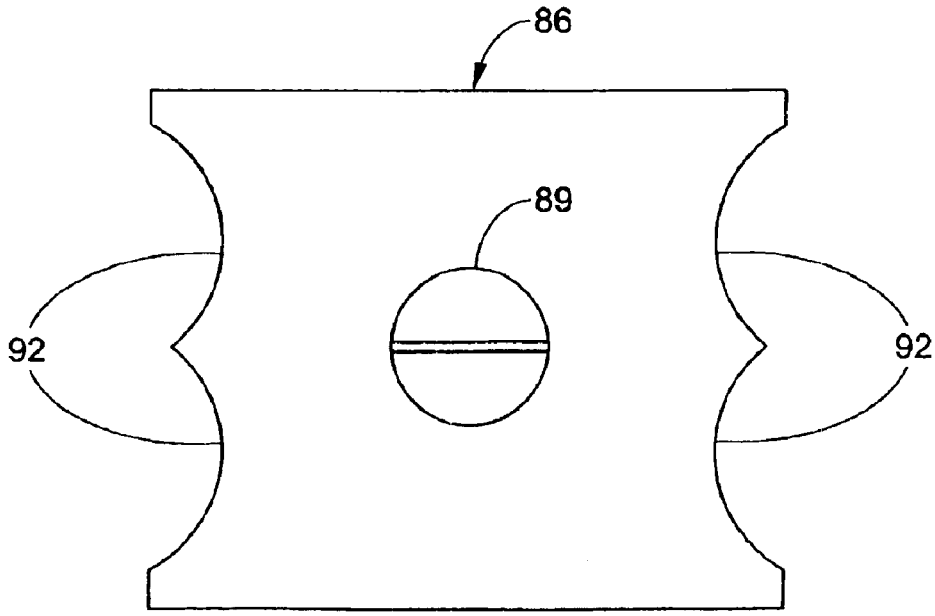
FIG. 10 is a top plan view of a pivot plate of FIG. 9.

In an alternative embodiment, as depicted in FIGS. 9 and 10, knife-edge bearings can be used in lieu of the trunnions and bearings described above. In this embodiment, a knife-edge pivot plate 86 is secured to carriage 4 on opposite sides via conventional fasteners or screws 89. Each pivot plate 86 is secured in place via an edge of a housing 88 and screw 89. Post-holding plates 90, which are utilized instead of a base, hold pivot posts 87 in place on an instrument 91 using a fastener 93. With reference now to FIG. 10, four arcuate knife-edge bearing races 92 are provided on each pivot plate 86. The races are symmetrical allowing the plate to be rotated 180° thus extending the useful life of the plate 86. Carriage 4 thus rocks or pivots as sharpened edge 92 of the pivot plate 86 engages the post 87.

With reference back to FIG. 4, an extension 114 protrudes from a corner of the carriage. An arm 8 is mounted to the extension to rotate the carriage with respect to the base. A washer 17, such as a Belleville washer, is placed around an opening 116 of plate 117 extending from arm 8. The arm is secured to the extension 114 via a knobbed plunger adjusting bolt 11 installed in openings 116 and 118. A lock nut 14 is secured to bolt 11 such that the washer exerts a relatively constant force to hold the arm 8 to the carriage 4. A spring-adjustment plunger 7 is attached to bolt 11 on an underside of the extension. The plunger includes a round-shaped tab 122 that engages a similarly shaped receptacle (not shown) in a bottom surface of the extension 114, to prevent rotation of such plunger. The plunger is threaded and can move up and down as bolt 11 is turned to control the amount of compression of spring 12, which is aligned under the plunger.

A retaining clip 13 is installed in a slot 76 in extension 114. The clip exerts pressure on an underside of tab 9 and keeps the tab 9 polar in either extended or retracted positions and prevents the tab from rattling. Tab 9 is positioned between arm 8 and extension 114.

With reference back to FIG. 1, in operation, the arm 8 is tilted down from a horizontal position thus rotating the carriage 4, along with plate 31, and the wheels 5 simultaneously thus releasing small amounts of string 78 from each wheel 5. Each string is also supported by a bridge 10 having grooves therein for the strings. As can be seen in FIG. 1 further rotation is prevented when tab 9 contacts half-step stop peg 19. Peg 19 can be adjusted to allow exactly enough rotation to lower all strings' pitches by up to 2 half steps. Each wheel 5 is held in place by the tension of the strings 78 over the wheels.

Figure 6:
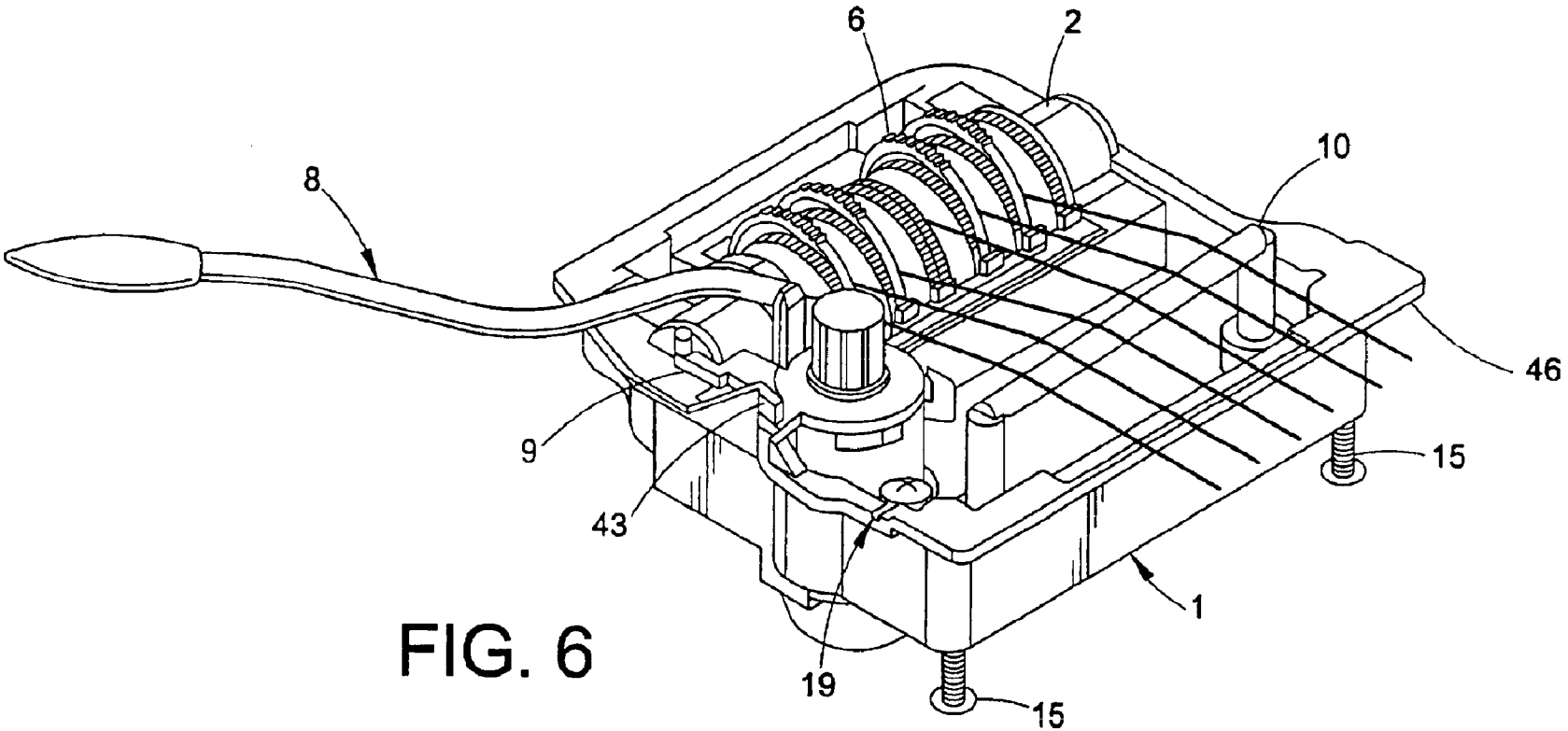
FIG. 6 is a perspective view of the tremolo device of FIG. 1 with an arm rotated in a locked position and a half-step stop tab in a retracted position.

With reference now to FIG. 4, the base 1 includes a lock socket 50 into which a locking element 43 on the plate 117 of the arm 8 can be received. When the locking element 43 resides in the lock socket 50, the carriage 4 is prevented from rotating, as shown in FIG. 6.

Figure 2:
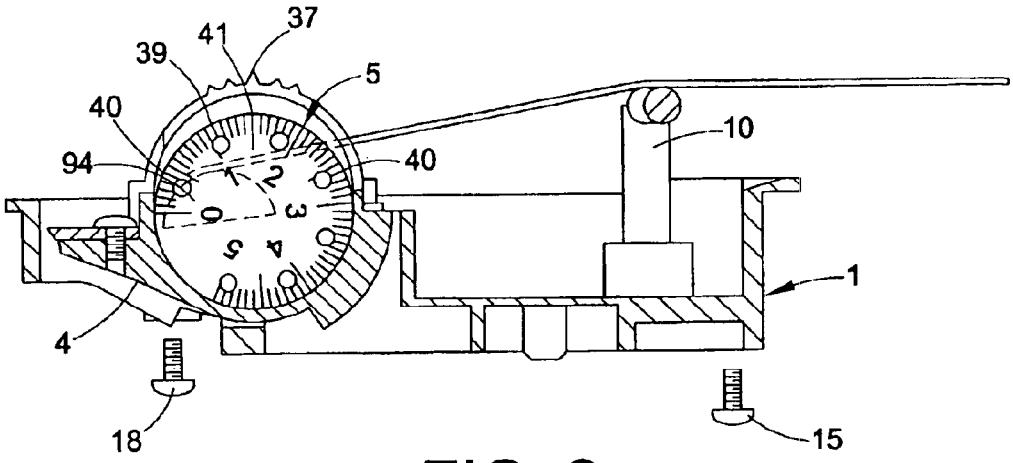
FIG. 2 is a side elevational view of the tremolo device of FIG. 1 wherein relative rotation of a reeling member unreels string from an associated stringed instrument at a maximum rate.

With reference now to FIG. 2, the wheel 5 in this figure is positioned such that rotation of the carriage with respect to the base results in a maximum rate of unreeling string. Each wheel 5 includes a cam 94 shaped such that the amount of string released by each 1 degree (1°) clockwise rotation of the cam results in approximately 1.010 times the amount of string released by the preceding 1 degree (1°) clockwise rotation.

Figure 3:
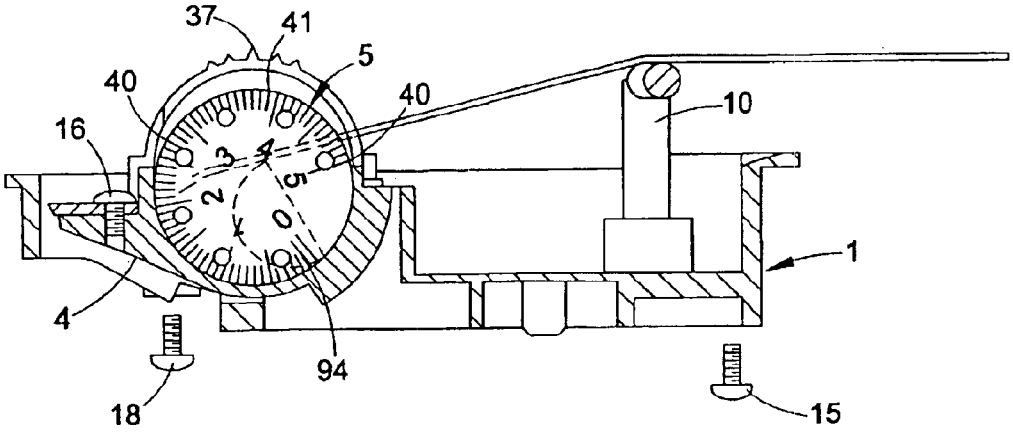
FIG. 3 is a side elevational view of the tremolo device of FIG. 1 wherein relative rotation of the reeling member unreels string from an associated stringed instrument at a minimum rate.
Figure 3A:
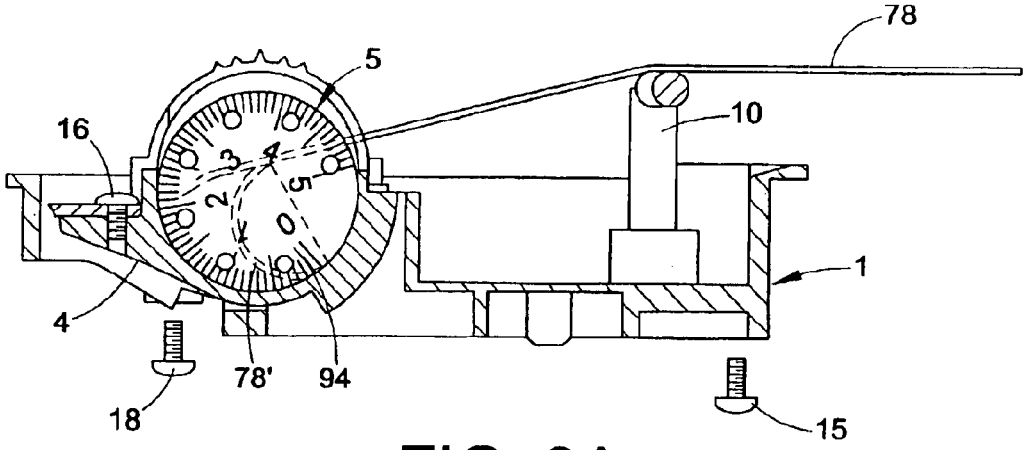
FIG. 3A is a side elevational view of a tremolo device illustrating a hypothetical situation for unreeling of string from a cam member.

The design of the cam will be described by referring to a hypothetical situation depicted in FIG. 3A. String 78' runs along the outer surface of cam 94 past the numerals "2" and "1" marked on wheel 5 and is attached to the cam near the numeral "0" marked on wheel 5. As the wheel is rotated clockwise to release the string, the shape of the outer surface of the cam is such that the amount of string released by each successive 1° clockwise rotation of the cam equals approximately 1.010 times the amount of string released by the preceding 1° clockwise rotation. In the device of the preferred embodiment, the string does not actually run along the cam outer surface as shown in FIG. 3A.

For ease of explanation, the amount of string released by 1° of rotation divided by the amount of string released by the preceding 1° of rotation is referred to as the "acceleration multiple". In the preferred embodiment of the present invention, the "acceleration multiple" is 1.010 times the amount of string released by the preceding 1° clockwise rotation. However, other acceleration multiples such as 1.005 and 1.050 can be used. Thus, the exact shape of the cam is a function of the length of string that the user wishes to unreel as compared to the previous length of string already unreeled. In the preferred embodiment, the shape was designed by "successive relaxation" iterations via an advanced mathematical solution. Referring to FIGS. 2 and 3, the position of the cam in FIG. 3 would release far less string 78 than the same amount of rotation of FIG. 2 with the cam in a different orientation.

In this embodiment where the acceleration multiple is 1.010 and the diameter of the unreeling wheel 5 is 1.126 inches, the configuration of outer surface of the cam 4 can be formed by the table of coordinates where "0, 0" is the origin and corresponds to the center of the wheel 5. The units for the table are in inches. By plotting a curved line through the x,y coordinates of the table below, the shape of the cam can be determined.

| X | Y |
|---|---|
| 0.0117 | 0.0224 |
| 0.0168 | 0.0238 |
| 0.0228 | 0.0244 |
| 0.0298 | 0.0238 |
| 0.0376 | 0.0218 |
| 0.0460 | 0.0179 |
| 0.0546 | 0.0120 |
| 0.0630 | 0.0037 |
| 0.0708 | −0.0073 |
| 0.0774 | −0.0210 |
| 0.0820 | −0.0374 |
| 0.0839 | −0.0566 |
| 0.0823 | −0.0782 |
| 0.0764 | −0.1017 |
| 0.0652 | −0.1265 |
| 0.0482 | −0.1517 |
| 0.0245 | −0.1764 |
| −0.0063 | −0.1989 |
| −0.0447 | −0.2179 |
| −0.0906 | −0.2314 |
| −0.1438 | −0.2375 |
| −0.2036 | −0.2341 |
| −0.2691 | −0.2189 |
| −0.3385 | −0.1897 |
| −0.4096 | −0.1442 |
| −0.4797 | −0.0803 |
| −0.5402 | −0.0041 |
| −0.5486 | 0.0112 |
| −0.5541 | 0.0277 |
| −0.5568 | 0.0449 |
| −0.5564 | 0.0623 |
| −0.5530 | 0.0794 |
| −0.5466 | 0.0957 |

Figure 5:
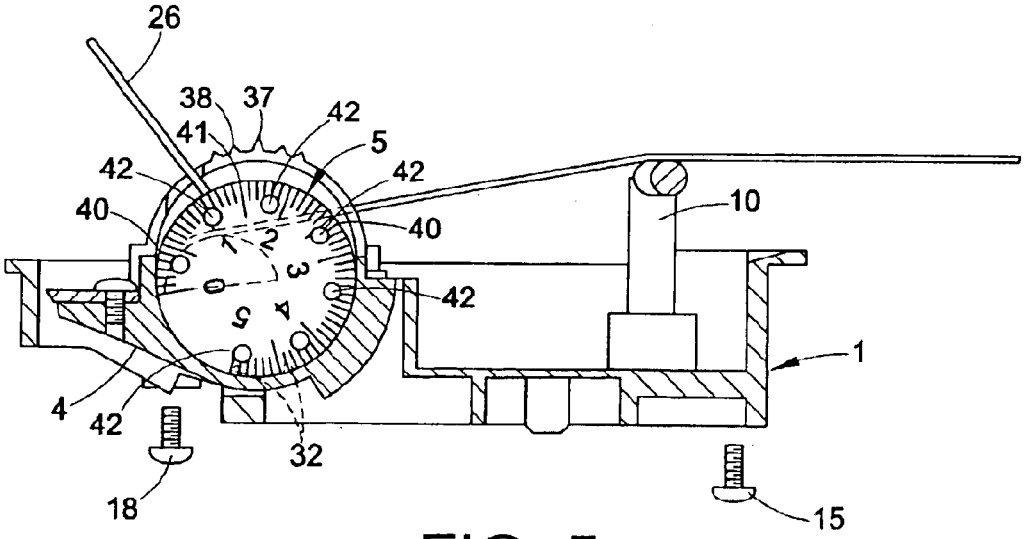
FIG. 5 is a side elevational view of the tremolo device of FIG. 1 showing components used to adjust the tremolo device when using alternative tunings or transforming chords.

Referring now to FIG. 2, each wheel 5 includes evenly spaced visual aligning grooves 39, which are set 5.805 degrees or 1/62 of a 360 degree rotation apart. Each wheel 5 also includes three inked visual aligning grooves, grooves 41 and alternative grooves 40, the inked groove 41 being associated with the same pitch change as the standard setting and one groove 40 being associated with one half the pitch change as the standard setting and the other groove 40 being associated with double the pitch change as the standard setting. With reference now to FIG. 5, rotational restraints 32 are provided in the form of tabs or knobs for preventing wheels 5 from rotating with respect to the carriage 4. Referring back to FIG. 2, wheel 5 is shown with groove 41.

To move the pitch of a string up one half-step requires the length of the string being reeled in to equal the portion of string reeled for the preceding half-step multiplied by the sixth root of two ($2^{(1/6)}$). The cam 94 on wheel 5 shown in FIG. 2 has been designed so that when such wheel 5 is reset by rotating it clockwise 1 degree within carriage 4 it will unreel 1.010 times the amount of string that would have been unreeled for each degree of rotation of such carriage 4 and wheel 5. Each wheel 5 is designed to allow resetting within the carriage 4 in 5.805 degree increments, or half of 11.61 degrees, to ensure that there will be an error of no more than 2.91 degrees or 3% of a half step's pitch change. Also with this arrangement, each wheel 5 can be reset within the carriage 4 in 11.61 degree increments. It is to be noted that $1.010^{11.61}$ equals the desired $2^{(1/6)}$. It should also be noted that 5.805 degrees equals 1/62 of a 360 degree rotation.

When the musician has tuned the string down one half step below regular tuning and still wants to have the string's pitch change by one half step when the other strings change in pitch by one half step, the cam 94 on wheel 5 for the retuned string now needs to release $2^{(-1/6)}$ times as much string. To make such an adjustment, an extrusion or adjustment tool 26 as shown in FIG. 5 is inserted into one of extraction holes 42 within the wheels in a position in a convenient location for lifting the wheel. The wheel is lifted from the restraints 32 and is rotated so that its inked visual aligning groove 41 is directly aligned with a finger portion 38 extending from the retaining assembly which is positioned 11.61 degrees of a counterclockwise rotation of the wheel farther from the bridge 10 than the finger portion 37. The wheel is then lowered back into engagement with the restraints 32.

When the musician has tuned this string down one half step below regular tuning but wants to have the string's pitch change by one half step when the other strings change in pitch by two half steps, the wheel 5 can be rotated so groove 40 at the "2.6" position is directly aligned with finger portion 38, which can result in a chord changing character from minor to major.

Each string's wheel has a specific group of three inked visual aligning grooves 39 illustrated as visual aligning grooves 40 and 41 to realize the objectives of releasing more or less string so that all strings change pitch at the same rate, or one half or double such rate, even if nonstandard tuning patterns are used.

Figure 8:
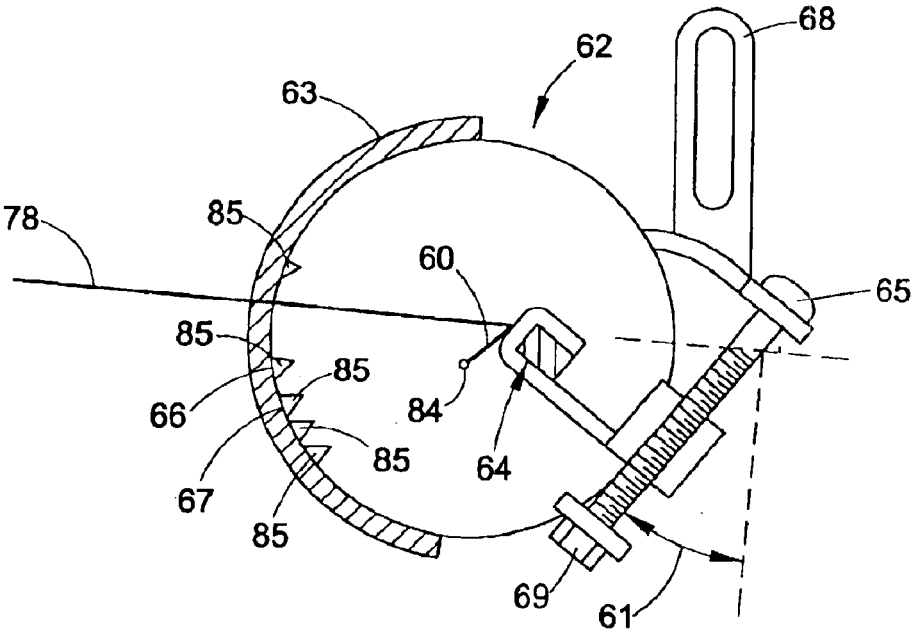
FIG. 8 is a side elevational view of a tremolo device in accordance with another preferred embodiment of the present invention.

An alternative embodiment of the present invention is shown in FIG. 8. Each of the separate tubular structures includes a string-grasping element mounted on a screw-drive support that can be adjusted to change the radius from the pivot point (so all strings can change in pitch by virtually the same amount) and notches that allow such separate tubular structure to be rotated within the main tubular structure.

The amount of string released on this device is directly proportional to radius 60, i.e. the distance from rotational axis 84 of the device to where the string 78 contacts member 64 times the cosine of angle 61 between an imaginary line perpendicular to the string and an imaginary line from the axis 84 and the member 64 holding the string. Each string is mounted on a rotatable tubular structure 62 that is supported within a main structure or housing 63 (similar to carriage 4 previously described) that rotates when vibrato is required. Each of the structures 62 includes an element 64 mounted on a support 65 that can be adjusted to change the radius from axis 84 and controls the rate at which the string is released. Notches 66 are provided on structures 62 which allow structures 62 to be rotated within the main structure 63 and be held in place rotationally by a peg 67 on housing 63. Each support 65 is preferably in the form of a threaded screw, is held in place with a lock nut 69 or similar retention member.

FIG. 8 shows a structure 62 tilted back in the normal position. This design aids the operation since the cosine increase as the device is rotated to decrease the pitch and increases the torque on the spring being compressed; thus, the device actually provides some of the torque needed to operate itself. Catch peg 67 of the main structure 63 is positioned in the middle notch 85. If more string release is required due to tuning the string to a pitch one half step higher, the string is slackened to allow structure 62 to be pulled to the right and away from peg 67 and then structure 62 is rotated counterclockwise via handle 68 so the peg 67 engages the next notch 66. This decreases the angle between a line perpendicular to the string and an imaginary line from the center of rotation and a member holding the string, thus increasing the cosine of such angle so that $2^{(1/6)}$ times the previous amount of string is released. Notches 66 are arranged so that each setting releases $2^{(1/6)}$ times as much string as the previous setting.

Figure 7:
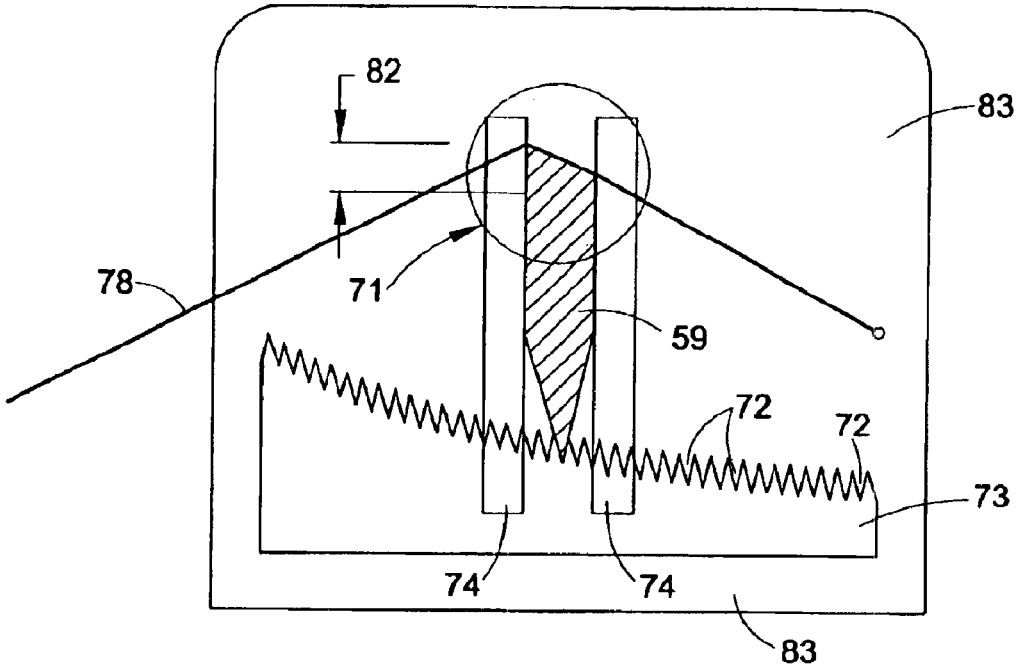
FIG. 7 is a side schematic view of a tremolo device having a ramp-like device in accordance with another embodiment of the present invention.

Another alternative embodiment utilizes a small, notched ramp 73 in lieu of wheels 5 and is shown in FIG. 7. An activator member 59 is located within a housing or case 83. A string 78 of the instrument extends over a portion of the activator member. Ramp 73 has a plurality of notches 72 therein. An end of the activator member engages one of the notches. The activator member is disengaged from the ramp and rotated with the case with respect to the ramp and is lowered to engage a notch of the ramp, thus changing the tension on the string. The notches 72 of the ramp are configured such that the top of an activator 59 is located at one notch position at a radius 82 equal to 1.0595 [or $2^{(1/2)}$] of the radius 82 that would result if the activator were suspended by an adjacent notch counterclockwise of the engaged notch. A guide 74 holds the activator 59 into position. Axle 71 is attached to case 83 which surrounds the assembly shown in FIG. 7. This embodiment allows for accurate assembly, rapid adjustment for changes in tuning for changes in string size, and to allow either one half or double tonal changes. This embodiment also allows ease of operation since the cosine increases as the device is rotated to decrease the string's pitch and this increases the torque on the counterbalancing spring being compressed; thus the device actually provides some of torque needed to operate itself.

The invention has been described with reference to the preferred embodiments. Obviously, modifications and alterations will occur to others upon reading and understanding the preceding detailed description. It is intended that the invention be construed as including all such modifications and alterations in so far as they come within the scope of the appended claims or the equivalents thereof.

What is claimed is:

1. A tremolo device for a stringed instrument comprising:

a base adapted to attach to an associated stringed instrument;

a plurality of adjustable string supports pivotally attached to said base, each of said supports supports a string of the associated stringed instrument, wherein said string supports each includes a surface configured such that 1 degree of rotation of said support in relation to said base results in a change in length of the string equal to l, a constant, multiplied by the change in length of said string due to the preceding 1 degree of rotation.

2. The tremolo device of claim 1, wherein adjustment of one of said string supports does not affect the pitch modification characteristics of said remaining string supports.

3. The tremolo device of claim 2, wherein said adjustment of said string supports can be made to accurately bend a chord made by said instrument.

4. The tremolo device of claim 1, wherein said constant l is equal to 1.010.

5. The tremolo device of claim 1, wherein said constant l is selected from a range of 1.005 to 1.050.

6. The tremolo device of claim 1, further comprising wheels upon which said string supports are mounted.

7. The tremolo device of claim 6, further comprising a carriage pivotally mounted to said base within an opening of said base, wherein said wheels are rotatably mounted within said carriage.

8. The tremolo device of claim 7, wherein said carriage comprises a string-anchoring member extending from an edge of said carriage comprising a plurality of slots for retaining said strings.

9. The tremolo device of claim 7, wherein said base comprises slots on opposing ends of said opening for retaining said carriage within said base.

10. The tremolo device of claim 7, wherein said carriage comprises at least one restraint member positioned within said opening to inhibit movement of said wheels in relation to said carriage.

11. The tremolo device of claim 7, wherein said carriage comprises trunnions extending from opposite sides of said carriage which rotatably mount said carriage to said base.

12. The tremolo device of claim 6, wherein each of said string supports comprises a cam upon which said string is supported.

13. The tremolo device of claim 12, wherein said cams are mounted to said wheels.

14. The tremolo device of claim 7, further comprising an arm pivotally mounted to said carriage for tilting said carriage.

15. The tremolo device of claim 14, further comprising a half step stop peg mounted to one of said musical instrument and said base and a retractable tab extending below said arm, wherein when said tab contacts said peg further movement of said carriage is prevented.

16. The tremolo device of claim 7, wherein said carriage comprises knife edge members that engage a portion of said base.

17. The tremolo device of claim 16, wherein said knife edge members are detachable from said carriage and said knife edge members include a plurality of arcuate surfaces, wherein at least one of said arcuate surfaces engages said portion of said base.

18. The tremolo device of claim 6, wherein each of said wheels has at least one visual aligning groove.

19. The tremolo device of claim 18, further comprising a restraining member positioned over said carriage, said restraining member comprises at least one finger portion, wherein said at least one visual aligning groove is aligned with said finger portion.

20. The tremolo device of claim 18, wherein said visual aligning groove has ink therein.

21. A tremolo device for a stringed instrument, comprising:

a plurality of string supports pivotally attached to said instrument, wherein each of said supports supports a string of said instrument, wherein each of said string supports comprises an adjustable peripheral surface that is shaped such that the amount of string released by one degree of rotation of said support divided by the amount of string released by the preceding one degree of rotation of said support is equal to a constant.

22. A tremolo device for a stringed instrument, comprising:

a base adapted to attach to an associated stringed instrument;

a carriage pivotally mounted to said base via knife edge members;

wherein said knife edge members are detachable from said carriage and said knife edge members include a plurality of arcuate surfaces, wherein at least one of said arcuate surfaces engages a portion of said base.

23. A method for using a tremolo device with strings of a musical instrument when one of said strings is tuned n half-steps from a datum pitch such that the tremolo device bends chords made by the instrument upon pivoting of the tremolo device with respect to the musical instrument, the method comprising:

providing alternative adjustment settings for each string so that the tremolo device releases $2^{(n/6)}$ times the amount of string released prior to adjusting the tremolo device for the retuned string, where n is the desired number of half-steps away from the datum pitch to which the string will be tuned.

24. The method of claim 23, where n can range from −2 to 2.

25. The method of claim 23, wherein said tremolo device comprises a base and a cam pivotally mounted to said base.

26. The method of claim 23, wherein said tremolo device comprises a ramp-like mechanism.

27. The method of claim 23, further comprising the step of providing predetermined alternative settings for releasing or tensioning of said strings, resulting in changing the pitch of one of said strings by either one half or twice the pitch change of the remaining strings.

28. A tremolo device for a stringed instrument comprising:

a housing;

an activator member located within said housing, wherein a string of said instrument extends over a portion of said activator member;

a ramp having a plurality of notches therein, wherein an end of said activator member engages one of said notches, wherein said activator member is rotated with respect to said ramp and engages a notch therein, thus changing the tension of said string, wherein said notches are configured such that when said activator member engages one of said notches a portion of said activator member is located at a radius equal to $2^{n/12}$ times the radius when said activator member engages a notch adjacent to said engaged notch.

29. The tremolo device of claim 28, wherein n=1.

30. A tremolo device for a stringed instrument, comprising:

a rotatable tubular member upon which a string is releasably mounted;

a housing which supports said tubular member;

an adjustable member mounted to said tubular member via a fastener that controls the rate at which string is released;

said tubular member comprises a plurality of notches;

said housing comprises at least one peg, wherein said tubular member is rotated so that one of said notches engages said peg of said housing, wherein said notches are positioned such that each counterclockwise rotation of said tubular member to a notch position releases $2^{(n/6)}$ times the amount of string as a previous notch position.

31. The tremolo device of claim 30, wherein said tubular member comprises a handle to rotate said tubular member.

32. The tremolo device of claim 30 wherein n=1.

* * * * *